US009678463B2

(12) United States Patent
Tanaka

(10) Patent No.: US 9,678,463 B2
(45) Date of Patent: Jun. 13, 2017

(54) IMAGE FORMING APPARATUS THAT ADJUSTS MAXIMUM DENSITY

(71) Applicant: CANON KABUSHIKI KAISHA, Tokyo (JP)

(72) Inventor: Sumito Tanaka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/960,937

(22) Filed: Dec. 7, 2015

(65) Prior Publication Data

US 2016/0195842 A1 Jul. 7, 2016

(30) Foreign Application Priority Data

Jan. 7, 2015 (JP) ..... 2015-001888

(51) Int. Cl.
*G03G 15/00* (2006.01)

(52) U.S. Cl.
CPC ..... *G03G 15/55* (2013.01); *G03G 15/5037* (2013.01); *G03G 15/5041* (2013.01)

(58) Field of Classification Search
CPC ..... G03G 15/0266; G03G 15/043; G03G 15/533; G03G 15/556; G03G 15/5033; G03G 15/5062
USPC ..... 399/9, 26–32, 38, 43, 46–51, 53–56
See application file for complete search history.

(56) References Cited

U.S. PATENT DOCUMENTS

| | | | | |
|---|---|---|---|---|
| 5,206,686 A * | 4/1993 | Fukui | G03G 15/01 358/406 |
| 5,697,012 A | 12/1997 | Sasanuma et al. | |
| 6,529,694 B1 * | 3/2003 | Fukaya | G03G 15/5058 347/140 |
| 8,995,011 B2 * | 3/2015 | Tanaka | H04N 1/6033 347/100 |
| 2003/0049039 A1 | 3/2003 | Suzuki | |

FOREIGN PATENT DOCUMENTS

| | | |
|---|---|---|
| JP | 04-267274 A | 9/1992 |
| JP | 05-223513 A | 8/1993 |
| JP | 2003-215981 A | 7/2003 |

* cited by examiner

*Primary Examiner* — Hoan Tran
(74) *Attorney, Agent, or Firm* — Fitzpatrick, Cella, Harper & Scinto

(57) ABSTRACT

An image forming apparatus includes: a photosensitive member; a charging unit configured to charge the photosensitive member; an exposure unit configured to expose the photosensitive member charged by the charging unit with a laser beam in order to form an electrostatic latent image; a development unit configured to develop the electrostatic latent image on the photosensitive member to form an image; an obtaining unit configured to obtain information related to the photosensitive member; a measuring unit configured to measure a measurement image formed by the charging unit, the exposure unit, and the development unit; and a determination unit configured to determine an image forming condition for adjusting a maximum density of the image to be formed, based on a measurement result of the measuring unit and the information obtained by the obtaining unit.

10 Claims, 8 Drawing Sheets

FIG. 4

| FILM THICKNESS OF PHOTOSENSITIVE MEMBER (μm) | DARK POTENTIAL (V) |
|---|---|
| 20 | 700 |
| 19 | 705 |
| 18 | 710 |
| 17 | 715 |
| 16 | 720 |
| 15 | 725 |
| 14 | 730 |
| 13 | 735 |
| 12 | 740 |
| 11 | 745 |
| 10 | 750 |

FIG. 7

| FILM THICKNESS OF PHOTOSENSITIVE MEMBER (μm) | 20 | 10 |
|---|---|---|
| DETECTION IMAGE | 1.0 | 1.0 |
| SOLID IMAGE | 1.4 | 1.6 |

FIG. 8

| FILM THICKNESS OF PHOTOSENSITIVE MEMBER (μm) | 20 | 10 |
|---|---|---|
| TARGET DENSITY | 1.0 | 0.8 |

| FILM THICKNESS OF PHOTOSENSITIVE MEMBER (μm) | 20 | 10 |
|---|---|---|
| DETECTION IMAGE | 1.0 | 0.8 |
| SOLID IMAGE | 1.4 | 1.4 |

IMAGE FORMING APPARATUS THAT ADJUSTS MAXIMUM DENSITY

BACKGROUND OF THE INVENTION

Field of the Invention

The present invention relates to an image forming apparatus such as a copier machine or a laser beam printer.

Description of the Related Art

Density correction control is performed in image forming apparatuses. For example, US Patent Application Publication No. 2003-0049039 discloses an image forming apparatus that forms a density correction image in a non-image region during an image forming operation, and determines image forming conditions for adjusting the image density, based on a result of measuring the density correction image with a sensor.

Also, in an electrophotographic image forming apparatus, a change in the capacitance of the photosensitive member brings about a change in the output image. It is known that the capacitance of the photosensitive member changes, for example, when the film thickness of a charge transfer layer of the photosensitive member decreases. The charging characteristics (sensitivity) of the photosensitive member change due to changes in the capacitance of the photosensitive member. Accordingly, the amount of developer that adheres to the photosensitive member changes.

The image forming apparatus executes maximum density control that determines the image forming conditions regarding the maximum density and executes gradation control in which control is performed such that the density of each gradation achieves a target density. In the case where maximum density control is executed, the image forming apparatus forms a measurement image on the photosensitive member and controls the image forming conditions for adjusting the maximum density based on the result of measuring the measurement image with a measuring unit. Here, when maximum density control is performed, a measurement image is formed that corresponds to a predetermined input signal value that is lower than the maximum input signal value, rather than forming a measurement image that corresponds to the maximum input signal value. However, when the capacitance of the photosensitive member changes due to, for example, changes in the film thickness of the photosensitive member, there is a possibility that the image forming conditions cannot be controlled to a high degree of accuracy, even if maximum density control is executed.

SUMMARY OF THE INVENTION

According to an aspect of the present invention, an image forming apparatus includes: a photosensitive member; a charging unit configured to charge the photosensitive member; an exposure unit configured to expose the photosensitive member charged by the charging unit with a laser beam in order to form an electrostatic latent image; a development unit configured to develop the electrostatic latent image on the photosensitive member to form an image; an obtaining unit configured to obtain information related to the photosensitive member; a measuring unit configured to measure a measurement image formed by the charging unit, the exposure unit, and the development unit; and a determination unit configured to determine an image forming condition for adjusting a maximum density of the image to be formed, based on a measurement result of the measuring unit and the information obtained by the obtaining unit.

Further features of the present invention will become apparent from the following description of exemplary embodiments with reference to the attached drawings.

BRIEF DESCRIPTION OF THE DRAWINGS

FIG. 4 is a diagram showing a relation between a film thickness of a photosensitive member and a dark potential of the photosensitive member according to one embodiment.

FIG. 7 is a diagram showing a relation between a film thickness of a photosensitive member and a target density of a detection image.

FIG. 8 is a diagram showing a relation between a film thickness of a photosensitive member and a target density of a detection image according to one embodiment.

DESCRIPTION OF THE EMBODIMENTS

Exemplary embodiments of the present invention are described below with reference to the drawings. Note that the following embodiments are examples and the present invention is not limited to the content of the embodiments. Also, regarding the following drawings, constituent elements that are not required for describing the embodiments have been omitted therefrom.

First Embodiment

Figure 1:
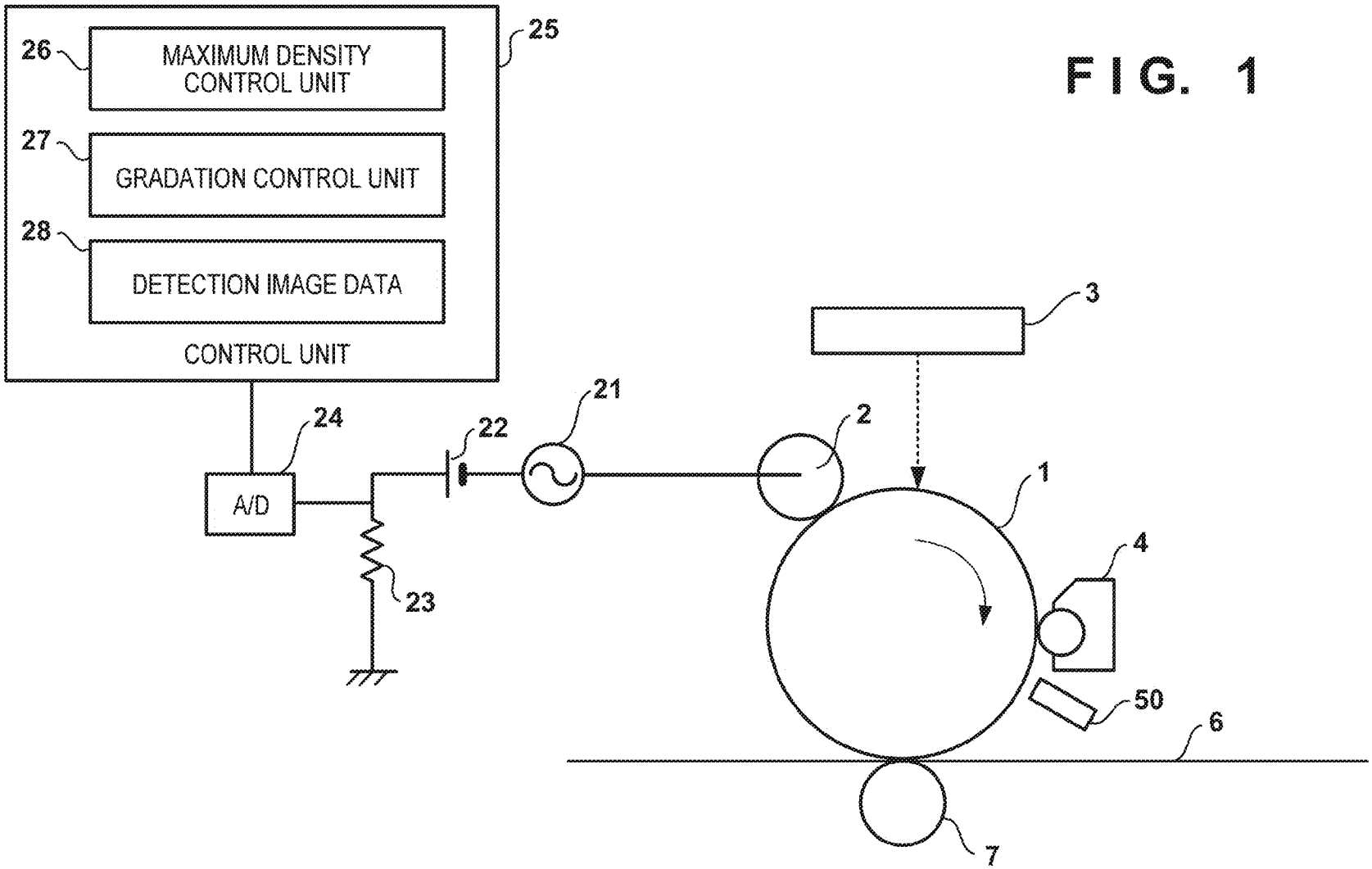
FIG. 1 is a schematic diagram of the configuration of an image forming apparatus according to one embodiment.

FIG. 1 is a diagram of the configuration of an image forming apparatus according to the present embodiment. A photosensitive member 1, which is an image carrier, is rotationally driven in the direction indicated by the arrow in the figure during image formation. A charging unit 2 charges the surface of the photosensitive member 1 to a uniform potential by outputting a charging bias. An exposure unit 3 scans and exposes the surface of the photosensitive member 1 with a light that corresponds to the image to be formed, and forms an electrostatic latent image on the surface of the photosensitive member 1. A development unit 4 outputs a development bias to cause developer to adhere to the electrostatic latent image on the photosensitive member 1 and accordingly the electrostatic image becomes visible as a developer image. A transfer roller 7 outputs a transfer bias to transfer the developer image on the photosensitive member 1 onto a recording material conveyed via a conveyance path 6. Thereafter, the recording material is conveyed to a fixing unit, which is not shown in the drawings, and the fixing unit fixes the developer image onto the recording material by heating and pressurizing the recording material. The recording material onto which the developer image is fixed is then discharged to the outside of the image forming apparatus. A detection unit 50 irradiates the photosensitive member 1 with light, and using the reflected light, detects the density of the developer image formed on the photosensitive member 1. In the present embodiment, the photosensitive member 1 is a negatively charged organic photoconductor (OPC), and a charge transfer layer of 20 μm in thickness is provided on a charge generation layer. Note that hereinafter the thickness of this charge transfer layer will be referred to as the film thickness of the photosensitive member 1.

FIG. 1 also shows a configuration for supplying a charging bias to the charging unit 2. In the present embodiment, an AC power supply 21 and a DC power supply 22 supply a voltage obtained by superimposing an AC voltage and a DC voltage as the charging bias to the charging unit 2. A charging current flows to a resistor 23 from the photosensitive member 1 and the charging unit 2 due to the charging unit 2 outputting the charging bias. Accordingly, the voltage of the resistor 23 will correspond to the charging current. An analog/digital converter (A/D) 24 converts the voltage of the resistor 23, which corresponds to the charging current, into a digital signal and inputs the digital signal to a control unit 25. The control unit 25 performs overall control of the image forming apparatus. A maximum density control unit 26 of the control unit 25 determines the image forming conditions, such as the contrast potential, that determine the maximum density. The contrast potential is the difference between the potential of the region in which the electrostatic latent image of the photosensitive member 1 is formed (hereinafter "light potential") and the development bias. Note that the difference between the potential of the region in which the electrostatic latent image of the photosensitive member 1 is not formed (hereinafter "dark potential") and the development bias is called a back contrast potential. Also, a gradation control unit 27 performs control that generates a gradation correction table for maintaining the linearity of the density of the image to be formed by input image data. In the case where an image is to be formed, the image forming apparatus converts the input image data according to the gradation correction table, and forms an image on the photosensitive member 1 by controlling the exposure unit 3 based on the converted image data. Also, the image forming conditions determined by the maximum density control unit 26 are used at this time. The control unit 25 holds detection image data 28 for maximum density control and for the detection image used in generation of the gradation correction table.

Figure 2:
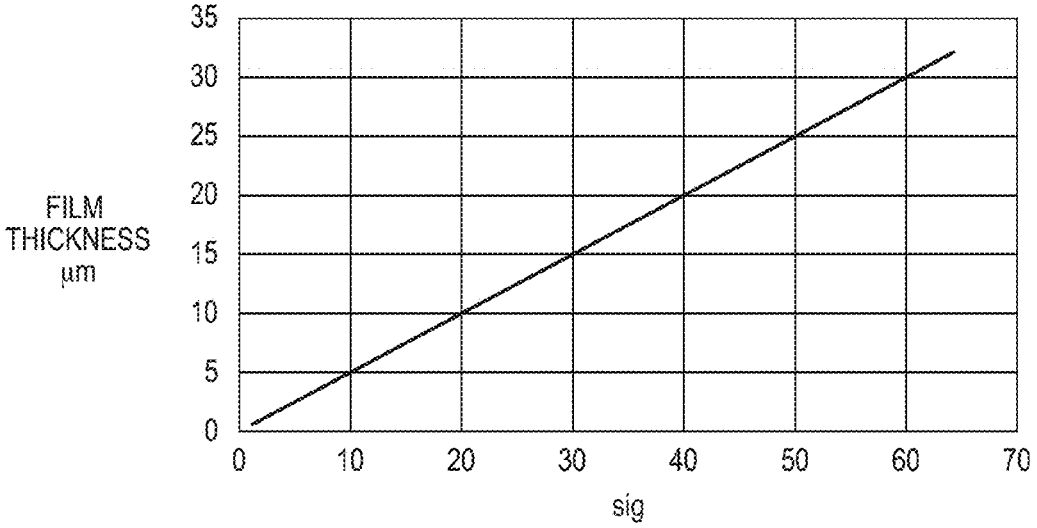
FIG. 2 is a diagram showing a relation between a charging current and a film thickness according to one embodiment.

Also, the control unit 25 detects the film thickness of the photosensitive member 1 based on the value of the charging current. The film thickness decreases due to use of the photosensitive member 1 and thus the film thickness is information that indicates the degree of degradation of the photosensitive member 1. FIG. 2 shows the relation between the charging current and the film thickness of the photosensitive member 1. Accordingly, the analog/digital converter (A/D) 24 for measuring the charging current shown in FIG. 1 functions as a film thickness detection unit. Note that in the present embodiment, the film thickness of the photosensitive member 1 is detected using the charging current, but a configuration may be employed in which the film thickness of the photosensitive member 1 is predicted and detected by using information that indicates the degree of degradation of the photosensitive member 1, such as the rotation time of the photosensitive member 1, the rotation amount (number of rotations), the number of pages of the image formed and transferred onto recording material, and the like.

Figure 3:
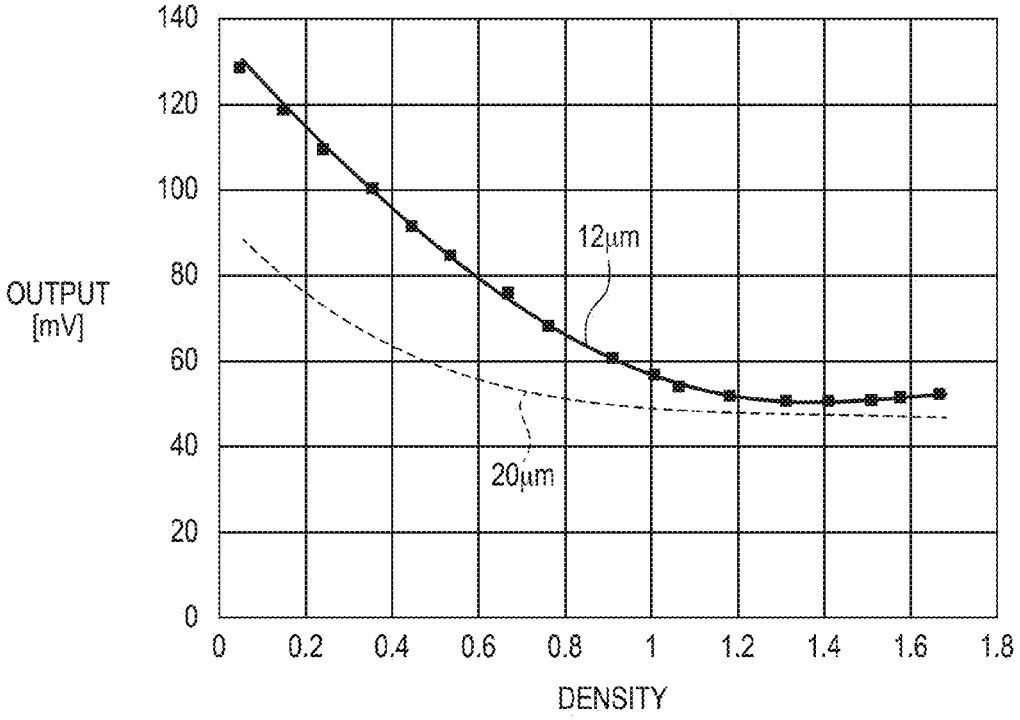
FIG. 3 is a diagram showing a relation between a detected density of an image formed on a photosensitive member and a density after the image has been fixed to a recording material according to one embodiment.

FIG. 3 shows a relation between the result of performing detection on a detection image formed on the photosensitive member 1 with the detection unit 50 and the measured density of the image after being transferred and fixed onto the recording material. Note that the horizontal axis in FIG. 3 indicates the density of the image fixed to the recording material, and the vertical axis indicates the detection result of the image by the detection unit 50, that is to say, the vertical axis indicates the voltage of the output signal that is output by the detection unit 50 according to the amount of light received by the detection unit 50. Note that the amount of reflected light decreases when the density of the detection image increases, and therefore the density decreases as the value on the vertical axis of FIG. 3 increases. It is understood from FIG. 3 that the output from the detection unit 50 is saturated in a region with high density. Accordingly, in the present embodiment, a medium density image with high sensitivity with respect to a change in density, that is to say, an image with a density lower than that of a solid image, is used as the detection image for maximum density control.

The required contrast potential increases when the film thickness of the photosensitive member 1 decreases. Also, because the image forming conditions regarding maximum density are determined using a detection image with a medium density, the contrast potential is changed according to the film thickness of the photosensitive member 1 in maximum density control according to the present embodiment. More specifically, in maximum density control, the contrast potential is increased when the film thickness of the photosensitive member 1 decreases. Note that in order to ensure the necessary value as the back contrast potential in maximum density control, the charging bias is increased to change the dark potential of the photosensitive member 1 when the film thickness of the photosensitive member 1 decreases. FIG. 4 is a diagram showing the relation between the film thickness of the photosensitive member 1 and the dark potential according to the present embodiment. As shown in FIG. 4, in the present embodiment, increasing the charging bias when the film thickness of the photosensitive member 1 decreases accordingly increases the dark potential. Note that the charging bias is changed by controlling the DC power supply 22 in FIG. 1. In this case, as shown in FIG. 3, even when the density is the same after fixation onto the recording material, the density detected on the photosensitive member 1 by the detection unit 50 differs according to the film thickness of the photosensitive member 1. In FIG. 3, even when the density is the same after fixation onto the recording material, the result of detecting the density on the photosensitive member 1 is lower in the case where the film thickness is 12 μm than it is in the case where the film thickness is 20 μm. The reasons for this are described below.

Figure 5A:
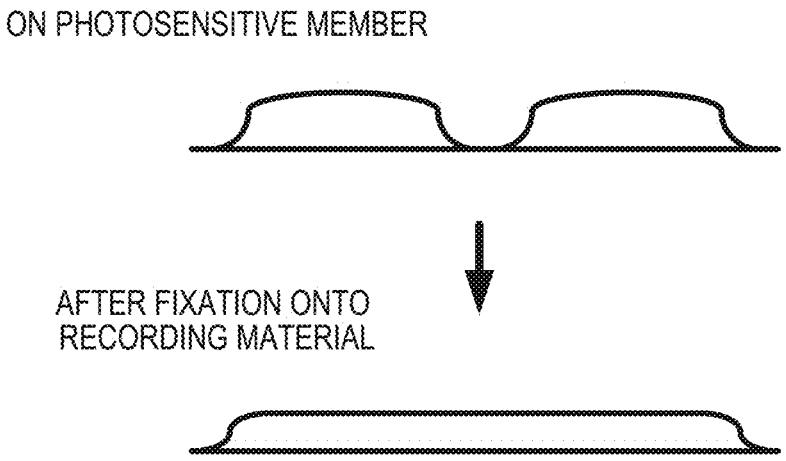
FIGS. 5A and 5B are diagrams illustrating a relation between a film thickness of a photosensitive member and an image that is formed according to one embodiment.
Figure 5B:
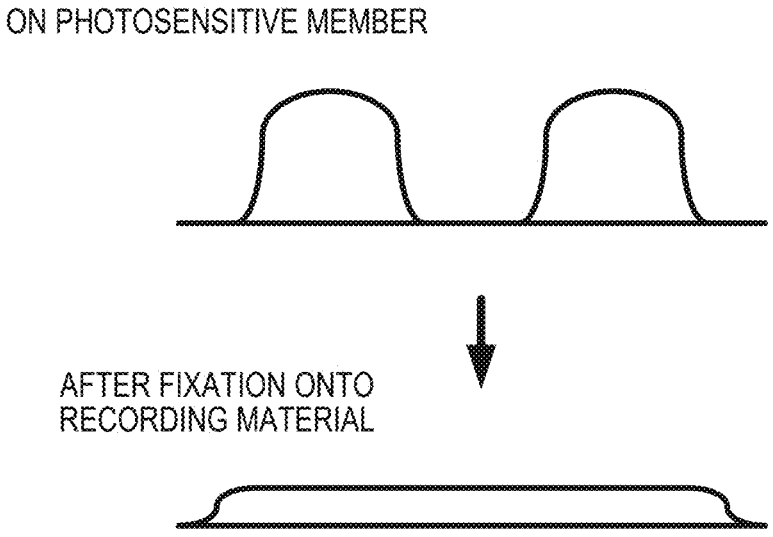
Figure 6A:
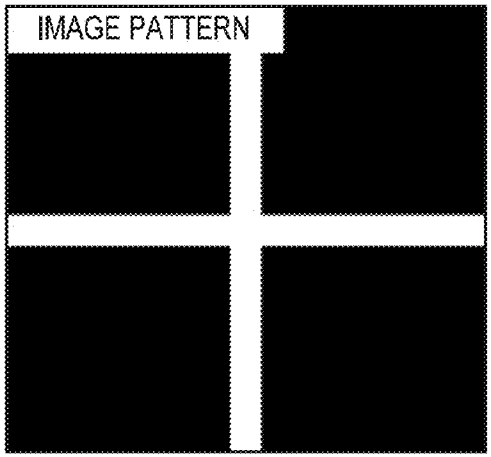
FIGS. 6A to 6C are diagrams illustrating a relation between a film thickness of a photosensitive member and an image that is formed according to one embodiment.
Figure 6B:
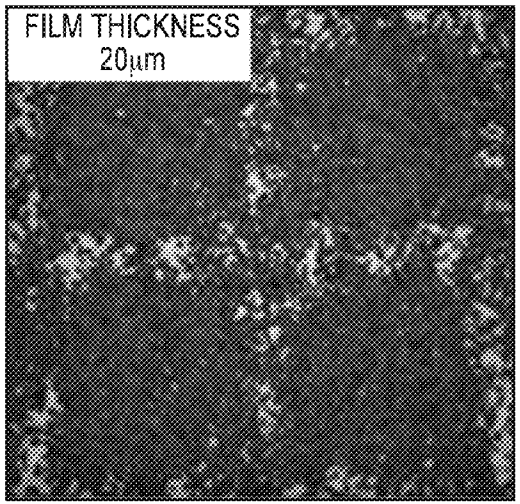
Figure 6C:
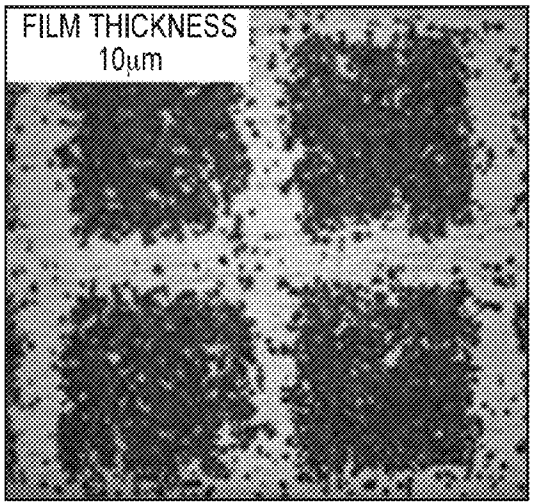

First, as described above, the contrast potential is increased when the film thickness of the photosensitive member 1 decreases. FIGS. 5A and 5B are diagrams showing an image formed on the photosensitive member 1 and a state in which the image has been fixed onto the recording material, as viewed from a direction parallel to the surface of the photosensitive member 1 and to the recording material. Note that the film thickness of the photosensitive member 1 in FIG. 5A is thicker than that in FIG. 5B. Also, the density of the images fixed to the recording material in FIGS. 5A and 5B are assumed to be equal. The contrast potential is increased when the film thickness of the photosensitive member 1 decreases. Accordingly, as shown in FIGS. 5A and 5B, the thickness of the developer image formed on the photosensitive member 1 increases when the film thickness of the photosensitive member 1 decreases. The image on the photosensitive member 1 shown in FIG. 5B has a thickness that is greater than that of the image on the photosensitive member 1 shown in FIG. 5A, but the area of the photosensitive member 1 covered by developer is smaller. Accordingly, when the density of the image on the photosensitive member 1 is measured by the detection unit 50, the density is detected as being lower due to the area of the surface of the photosensitive member 1 covered by developer in FIG. 5B being smaller than that in FIG. 5A. However, the recording material is pressurized when the image is transferred and fixed onto the recording material, and therefore the area of the surface of the recording material covered by developer is the same for FIGS. 5A and 5B. Accordingly, the density of the image fixed onto the recording material is the same in FIGS. 5A and 5B. This is the reason that the density detected on the photosensitive member 1 differs according to the film thickness, even when the density is the same after fixation of the image onto the recording material. FIGS. 6B and 6C are diagrams respectively showing an image of four aligned squares shown in FIG. 6A when formed on the photosensitive member 1 with a film thickness of 20 μm and when formed on the photosensitive member 1 with a film thickness of 10 μm, as viewed from a direction that is orthogonal to the surface of the photosensitive member 1. Note that the density of the images transferred and fixed onto the recording material in FIGS. 6B and 6C is the same. In FIG. 6C, it can be understood that the exposed area of the surface of the photosensitive member 1 is larger than that of FIG. 6B, and accordingly, that the density is measured as being low.

FIG. 7 shows the results of determining the contrast potential with the target density of the medium density image that is used in maximum density control set to be 1.0. Note that the density in FIG. 7 is the density after fixation onto the recording material. As shown in FIG. 7, following maximum density control, the density of the detection image achieves the target density irrespective of the film thickness of the photosensitive member 1. However, the density of the solid image with a density higher than that of the detection image changes according to the film thickness. In the present embodiment, the maximum density is controlled to be constant even if the film thickness of the photosensitive member 1 changes, and therefore the target density of the detection image is changed according to the film thickness of the photosensitive member 1. FIG. 8 shows the relation between the film thickness of the photosensitive member 1 and the target density of the detection image. As shown in FIG. 8, the target density is reduced when the film thickness of the photosensitive member 1 decreases. Note that in the case where the film thickness of the photosensitive member 1 is greater than 10 μm and less than 20 μm, the target density is determined by linear interpolation.

Figure 9:
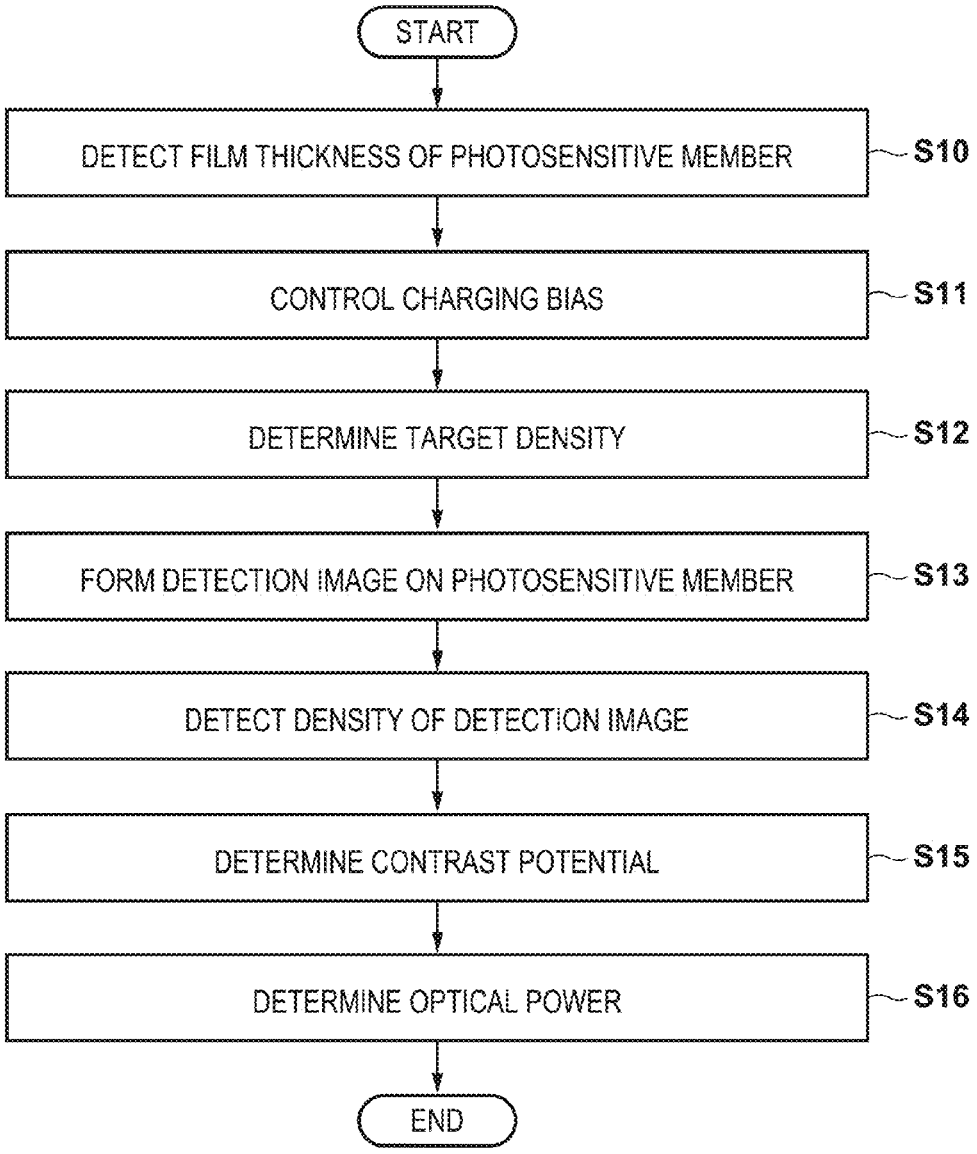
FIG. 9 is a flowchart of maximum density control according to one embodiment.

FIG. 9 is a flowchart for maximum density control. In step S10, the control unit 25 detects the film thickness of the photosensitive member 1 by using the charging current, and in step S11, controls the charging bias such that the photosensitive member is charged to a dark potential that corresponds to the film thickness. In step S12, the maximum density control unit 26 determines the target density of the detection image for the maximum density control based on the film thickness of the photosensitive member 1. In step S13, the maximum density control unit 26 forms the detection image on the photosensitive member 1. Note that when forming the detection image, conversion according to the gradation correction table is not performed. In step S14, the maximum density control unit 26 detects the density of the detection image based on the output from the detection unit 50. In step S15, the maximum density control unit 26 determines the contrast potential based on the detected density and the target density of the detection image, and in step S16, determines the optical power for achieving the determined contrast potential. Note that optical power here corresponds to the exposure intensity for the exposure unit 3 to expose the photosensitive member 1, and the light potential of the photosensitive member 1 is determined using this optical power. Note that the contrast potential may be controlled by changing the development bias or the charging bias rather than the optical power. Note that the gradation control unit 27 generates the gradation correction table for gradation correction by forming a detection image with multiple gradations on the photosensitive member 1 or on the recording material under the image forming conditions determined by the processing in FIG. 9, and accordingly, performs correction of the intermediate density.

Figures 10, 11:
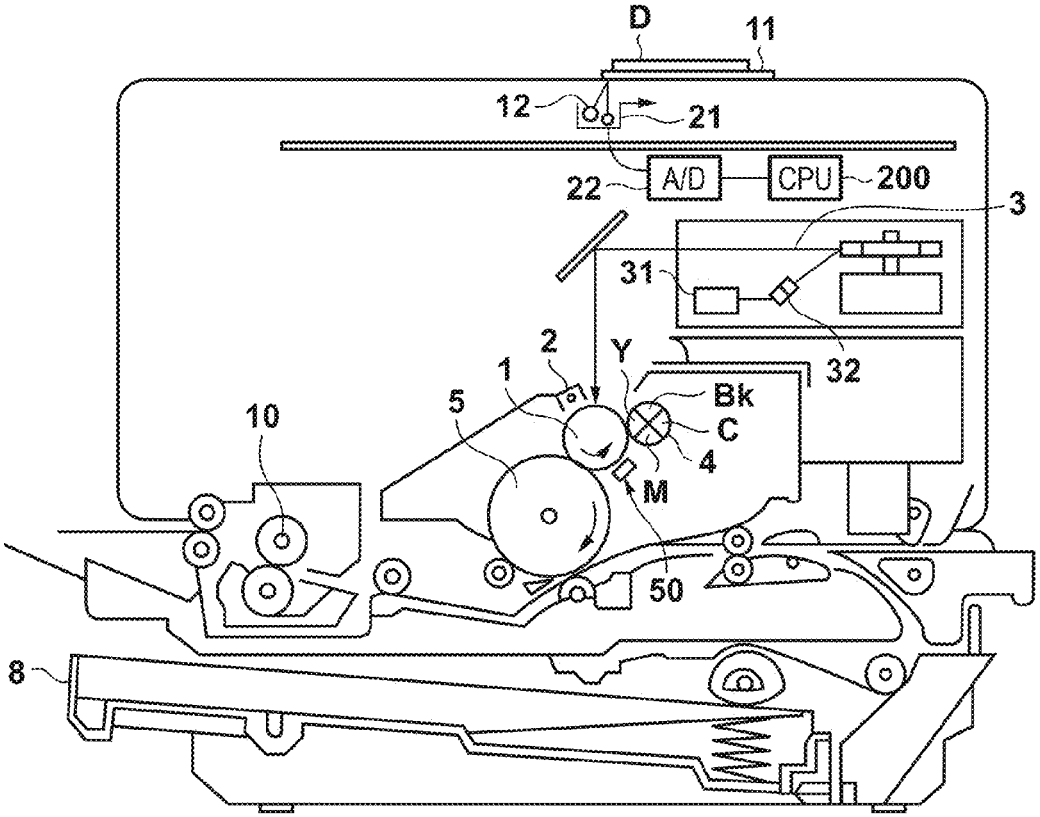
FIG. 10 is a diagram showing a density of a detection image and a density of a solid image after being fixed to a recording material according to one embodiment.
FIG. 11 is a schematic diagram of a configuration of an image forming apparatus according to one embodiment.

FIG. 10 shows the results of changing the target density of the detection image according to the film thickness of the photosensitive member 1, as shown in FIG. 8. As shown in FIG. 10, the density of the solid image is constant, irrespective of the film thickness of the photosensitive member 1, due to the target density of the detection image having been changed according to the film thickness of the photosensitive member 1.

As described above, in the present embodiment, the target density of the detection image is changed according to the film thickness of the photosensitive member 1, that is to say, the degree of deterioration of the photosensitive member 1. According to this configuration, the maximum density control can be performed to a high degree of accuracy irrespective of the degree of deterioration of the photosensitive member 1.

Second Embodiment

The first embodiment was described using a monochrome image forming apparatus. The present embodiment is described using a color image forming apparatus. FIG. 11 is a diagram of the configuration of the image forming apparatus according to the present embodiment. The charging unit 2 charges the surface of the photosensitive member 1 to a uniform potential by outputting a charging bias. The exposure unit 3 scans and exposes the surface of the photosensitive member 1 with a light that corresponds to the image to be formed, and forms an electrostatic latent image on the surface of the photosensitive member 1. The development unit 4 has yellow (Y), magenta (M), cyan (C), and black (Bk) developer, and develops a developer image by developing the electrostatic latent image using any of the colors. The developer image formed on the photosensitive member 1 is transferred onto an intermediate transfer body 5. A Y developer image, an M developer image, a C developer image, and a Bk developer image are successively formed on the photosensitive member 1, and a color developer image is formed on the intermediate transfer body 5 by transferring the developer images such that the developer images overlap each other on the intermediate transfer body 5. The developer image formed on the intermediate transfer body 5 is transferred onto a recording material conveyed from a cassette 8. A fixing unit 10 fixes the developer image onto the recording material by heating and pressurizing the recording material.

The image forming apparatus of FIG. 11 is a copier machine, and image data is generated by reading the image of the original. A light source 12 irradiates an original D, which has been placed onto a platen 11, with light and a CCD 21 receives the reflected light and reads the image of the original D. An A/D conversion circuit 22 converts a signal that corresponds to the image of the original D output by the CCD 21 into a digital signal, and outputs the digital signal to a control unit that has a CPU 200. The CPU 200 generates a driving signal from the image signal and outputs the driving signal to a driver 31 of the exposure unit 3. The driver 31 drives a light source 32 by using the driving signal, and accordingly the light source 32 irradiates the photosensitive member 1 with light corresponding to the image to be formed, and an electrostatic latent image is formed on the photosensitive member 1.

In the present embodiment as well, a detection unit 50 for detecting the density of a detection image formed on the photosensitive member 1 is provided opposing the photosensitive member 1. Note that determination of the target density of the detection image is the same as that for the first embodiment, and the maximum density control can be performed to a high degree of accuracy, irrespective of the degree of degradation of the photosensitive member 1.

Also, a configuration may be employed in which memory such as a tag, onto which information regarding the thickness of the photosensitive member 1 is stored, is provided in the photosensitive member 1. The CPU 200 may set the target density based on the information stored in the tag.

Also, in the above description, a configuration was described in which the target density is determined based on information regarding the film thickness of the photosensitive member 1, but a configuration may be employed in which the target density is determined based on information regarding the capacitance of the photosensitive member 1, or a configuration may be employed in which the target density is determined based on the information of the total time taken by the charging unit 2 to charge the photosensitive member 1.

Other Embodiments

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be supplied to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-001888, filed on Jan. 7, 2015, which is hereby incorporated by reference herein in its entirety.

What is claimed is:

1. An image forming apparatus comprising:

a photosensitive member;

a charging unit configured to charge the photosensitive member;

an exposure unit configured to expose the photosensitive member charged by the charging unit with a laser beam in order to form an electrostatic latent image;

a development unit configured to develop the electrostatic latent image on the photosensitive member to form an image;

an obtaining unit configured to obtain information related to the photosensitive member;

a measuring unit configured to measure a measurement image formed by the charging unit, the exposure unit, and the development unit; and a determination unit configured to determine, based on a measurement result of the measuring unit and the information obtained by the obtaining unit, an image forming condition for adjusting a maximum density of the image to be formed.

2. The image forming apparatus according to claim 1, wherein the information corresponds to a capacitance of the photosensitive member.

3. The image forming apparatus according to claim 1, wherein the photosensitive member includes a charge transfer layer, and the information corresponds to a thickness of the charge transfer layer.

4. The image forming apparatus according to claim 1, wherein the obtaining unit includes a sensor configured to detect an electrical current supplied to the photosensitive member when the photosensitive member is charged by the charging unit, and the information corresponds to a detection result of the sensor.

5. The image forming apparatus according to claim 1, wherein the information corresponds to a number of rotations of the photosensitive member.

6. The image forming apparatus according to claim 1, wherein the information corresponds to an amount of time that the photosensitive member is charged by the charging unit.

7. The image forming apparatus according to claim 1, wherein the information corresponds to a number of pages of the image formed on the photosensitive member.

8. The image forming apparatus according to claim 1, wherein the image forming condition corresponds to an intensity of the laser beam of the exposure unit.

9. The image forming apparatus according to claim 1, wherein the image forming condition corresponds to a charging bias that is to be supplied to the charging unit in order for the charging unit to charge the photosensitive member.

10. The image forming apparatus according to claim 1, wherein the image forming condition corresponds to a development bias that is to be supplied to the development unit in order for the development unit to develop the electrostatic latent image.

* * * * *